United States Patent [19]

Ruhemann

[11] 4,400,947

[45] Aug. 30, 1983

[54] PRODUCING POWER FROM A CRYOGENIC LIQUID

[75] Inventor: Martin S. W. Ruhemann, Sale, England

[73] Assignee: Petrocarbon Developments Limited, Manchester, England

[21] Appl. No.: 275,438

[22] Filed: Jun. 19, 1981

[30] Foreign Application Priority Data

Jul. 1, 1980 [GB] United Kingdom ..... 8021552

[51] Int. Cl.[3] ..... F01K 23/04; F01K 25/06; F01K 9/00

[52] U.S. Cl. ..... 60/648; 60/655; 60/690; 60/693; 60/671

[58] Field of Search ..... 60/648, 655, 693, 690, 60/692, 651, 671

[56] References Cited

U.S. PATENT DOCUMENTS 3,257,806 6/1966 Stahl ..... 60/655
3,266,246 8/1966 Heller et al. ..... 60/655
3,892,103 7/1975 Antonelli ..... 60/648 X
4,231,226 11/1980 Griepentrog ..... 60/648

*Primary Examiner*—Allen M. Ostrager
*Assistant Examiner*—Peggy A. Loiacano
*Attorney, Agent, or Firm*—Curtis, Morris & Safford

[57] ABSTRACT

Power is produced from a methane-containing cryogenic liquid such as LNG by compressing the liquid and employing the compressed liquid as a refrigerant in the condensers of two closed and independent power cycles. The heat exchange medium in the first of the cycles evaporates in a lower temperature range than that at which the heat exchange medium in the second cycle condenses. The first heat exchange medium is condensed by heat exchange in a first heat exchange step with the compressed cryogenic liquid and the second heat exchange medium is condensed by heat exchange in a second heat exchange step with compressed cryogenic liquid recovered from the first heat exchange step and evaporating first heat exchange medium. Power is recovered from the expansion engines associated with the two power cycles.

9 Claims, 1 Drawing Figure

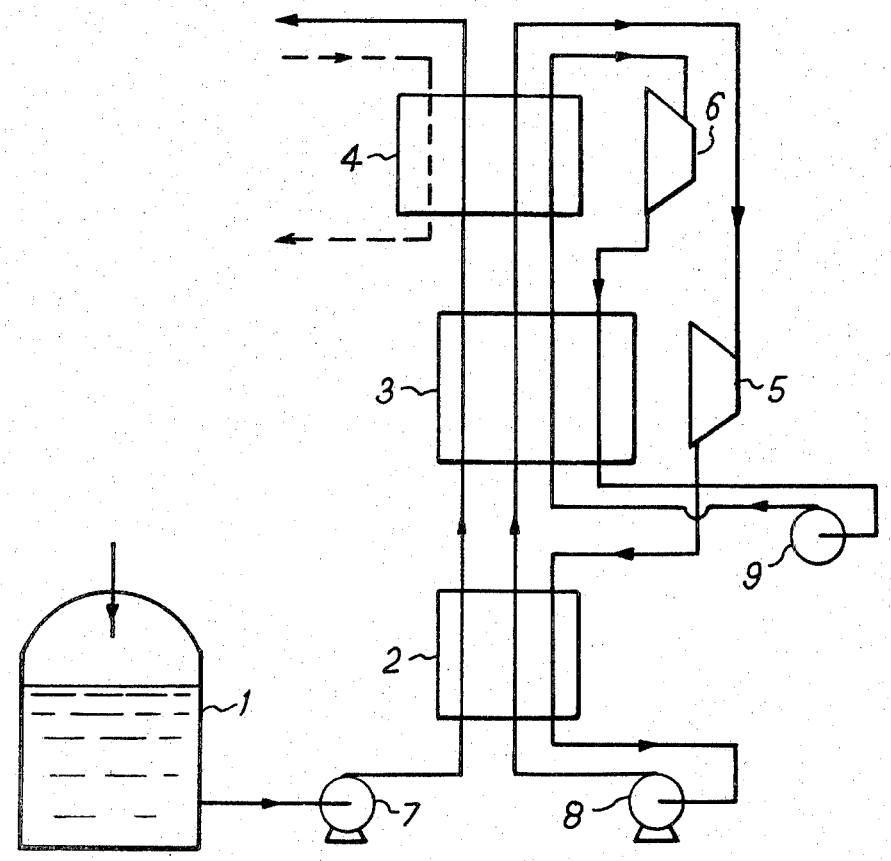
4
6
3
5
9
2
1
7
8

PRODUCING POWER FROM A CRYOGENIC LIQUID

This invention relates to the use of the cold content of a cryogenic liquid to produce power, and, in particular, to the production of power from methane-based cryogenic liquids such as liquefied natural gas (LNG).

Natural gas is normally transported overseas as a cold liquid in carrier vessels. At the receiving terminal this cold liquid, which is at near atmospheric pressure and at a temperature around −160° C., has to be evaporated and fed to a distribution system at ambient temperature and at a suitable elevated pressure, generally about 60–80 atm. The liquid is pumped to the required pressure, which is normally super-critical, so that, when its temperature is raised, no actual phase change occurs.

Although many suggestions have been made and some installations have been built to utilise the large cold potential of the LNG, in most receiving terminals this cold is wasted and the LNG is simply heated with a large flow of sea water, which has to be applied in such a manner as to avoid ice formation.

At a few terminals the cold is utilised in air separation plants or similar cryogenic installations, or for refrigeration purposes in the freezing and storage of foodstuffs.

It has also been proposed to use the cold LNG as a heat sink in a power cycle to generate electrical energy. A number of possible cycles have been proposed which seek to overcome the difficulties caused by the large temperature interval through which the LNG is heated and the particular shape of the warming curve which require the cycle medium or media to condense at varying temperatures. However, it has been found that with relatively simple cycles only a small part of the available cold can be utilised. Proposals to increase the efficiency employ more complex cycles involving a large number of turbines operating between different pressure levels. For example, BP946640 describes a simple two-turbine cycle which can produce electric power from LNG with an efficiency of about 15%. The proposal in publication II(11) in the Reports of the Fifth International Conference on Liquefied Natural Gas (1977) gives an efficiency of 45% but requires the use of a complex process involving four turbines.

This invention provides a method and arrangement which provides for the conversion of the cold in a methane-containing cryogenic liquid into power at a high efficiency using a relatively simple method and uncomplicated apparatus.

According to the present invention, there is provided a method of producing power from a store of a methane-containing cryogenic liquid such as liquefied natural gas, the method comprising (a) compressing the cryogenic liquid to supercritical pressure;

(b) providing first and second closed and independent power cycles employing, respectively, first and second methane-containing heat exchange media each of which undergoes isobaric condensation over a range of temperatures;

(c) in said first closed power cycle, compressing said first heat exchange medium in condensed form to a superatmospheric pressure $P_2$, evaporating it, expanding the evaporated medium to a lower superatmospheric pressure $P_1$ in a first expansion engine, condensing the expanded vapour and recycling the condensate so formed for recompression;

(d) in said second closed power cycle, compressing said second heat exchange medium in condensed form to a superatmospheric pressure $P_4$, evaporating it, expanding the evaporated medium to a lower superatmospheric pressure $P_3$ in a second expansion engine, condensing the expanded vapour and recycling the condensate so formed for recompression; and wherein (e) the temperature range at which the condensed first heat exchange medium evaporates at $P_2$ is lower than the temperature range at which the expanded second heat exchange medium condenses at $P_3$;

(f) the first heat exchange medium is condensed by indirect heat exchange with said compressed cryogenic liquid in a first heat exchange step at subambient temperature;

(g) the second heat exchange medium is condensed by indirect heat exchange at subambient temperature in a second heat exchange step with evaporating first heat exchange medium and with compressed cryogenic liquid recovered from said first heat exchange step; and (h) power is taken from said first and second engines.

By using, as the cycle media, media such as mixtures which undergo isobaric condensation over a range of temperatures, the warming curve of the cryogenic liquid is more closely matched and more efficient use can be made of the cold content of the liquid.

By arranging for the temperature at which the condensed first heat exchange medium evaporates to be lower than the temperature range at which the expanded second heat exchange medium condenses, and for the second heat exchange medium to be condensed by indirect heat exchange with evaporating first heat exchange medium and with the compressed cryogenic liquid, it is possible to circulate a larger flow of medium in the second power cycle than would otherwise be possible, and thus produce a greater amount of power, e.g. as electric energy, from a given amount of the cryogenic liquid.

With appropriate choice of heat exchange media and conditions, the power requirements of the pumps for the first and second heat exchange media and the cryogenic liquid may be only a small fraction of the power available from said first and second engines so that, for example, as much as about 90% of said power is available for export.

Methane-containing cryogenic liquids particularly suitable for use in the method of the invention include LNG and liquefied gases associated with oil sources. In general, such liquids will contain at least 40% methane and usually a major amount of methane, most generally in the range of 60 to 95% molar. Examples of suitable liquids and their compositions are

| | |
|---|---|
| Lean Natural Gas | 40–60% $CH_4 + N_2$ |
| Normal Natural Gas | 90–95% $CH_4 + N_2$ + heavier hydrocarbons |
| Rich Natural Gas | 80% $CH_4$ 30 heavier hydrocarbons |
| Associated Gas | 60–70% $CH_4$ + heavier hydrocarbons |

The critical pressures of such mixtures are generally in the range of 40 to 70 bar. In general, therefore, the pressure to which the cryogenic liquid is compressed will be at least 40 bar and will usually be about 60 to 80 bar although higher pressures e.g. up to 200 bar or more are possible.

For the method to be economically viable, the temperature at which the compressed cryogenic liquid is supplied to the first heat exchange step should be below −100° C. and preferably it is as low as possible, e.g. in the range −140° C. to −170° C., and usually about −160° C.

The compositions of the first and second heat exchange media and the selected condensing pressures thereof ($P_1$ and $P_3$) should be chosen so as to produce optimum matching of the two cooling curves of the condensing heat exchange media with the warming curve of the compressed cryogenic liquid in the two heat exchange steps.

The compositions of the heat exchange media will generally be established empirically but conveniently the heat exchange media will have the same major component or components as the cryogenic liquid, although in different proportions.

To obtain optimum matching of cooling and warming curves, as well as maximum flowrate of the heat exchange media, resulting in maximum power production, the following conditions should be aimed for:

(1) the bubble-point of the second heat exchange medium at its condensing pressure $P_3$ should be nearly equal to the dewpoint of the first medium at its condensing pressure $P_1$ (2) dew- and bubble-point of the second heat exchange medium at its condensing pressure $P_3$ should be slightly higher than dew- and bubble-point of the first heat exchange medium at its evaporating pressure $P_2$.

Condition (1) leads to a smooth cooling curve over an extended temperature interval. Condition (2) enables circulation in the second cycle to be increased above the flowrate associated with warming the treated cryogenic liquid, in that an additional amount of this cycle medium can be condensed by utilising the cold available from evaporation of the first heat exchange medium.

The heat exchange media may suitably comprise mixtures consisting mainly or wholly of methane and other light hydrocarbons, meaning hydrocarbons having 1 to 4 carbon atoms, and will generally have compositions approximately as follows

| | |
|---|---|
| Methane | 30–60% molar |
| $C_2$ hydrocarbons | 30–60% molar |
| $C_3$ hydrocarbons | up to 10% molar |
| Nitrogen | up to 10% molar |

and the values for $P_1$, $P_2$, $P_3$ $P_4$ are likely to be in the following ranges

| | |
|---|---|
| $P_1$ | 2–5 bar |
| $P_2$ | 15–25 bar |
| $P_3$ | 15–25 bar |
| $P_4$ | 35–50 bar |

The first and second heat exchange media may have the same composition, if desired, and the temperature range in which the condensed first heat exchange medium evaporates may be adjusted to be lower than that at which the expanded second heat exchange media condenses by suitable adjustment of the cycle pressures; i.e. with $P_3$ being greater than $P_2$.

It has been found that in most cases the process will operate satisfactorily using mixtures consisting mainly of methane and ethane as the first and second heat exchange media.

Significant increases in the circulations of the first and second heat exchange media, resulting in corresponding increases in the power produced by the first and second expansion engines, can be obtained by warming each of the condensed first and second heat exchange media, after compression, in the heat exchange step in which the same medium is condensed and in indirect countercurrent heat exchange relationship with the condensing medium. Thus, the condensed first heat exchange medium will be warmed, after compression to $P_2$, in said first heat exchange step and the condensed second heat exchange medium will be warmed, after compression to $P_4$, in said second heat exchange step.

The evaporation of the second heat exchange medium is suitably completed by heat exchange in a third heat exchange step with a third heat exchange medium which is preferably aqueous and may conveniently be water or, more preferably, brine, as in sea water.

Preferably, the evaporated media supplied to the expansion engines are in superheated form. The superheating of both the heat exchange media may be effected in this third heat exchange step.

Preferably, compressed cryogenic liquid recovered from the second heat exchange step is also passed in indirect counter-current heat exchange relationship with the third heat exchange medium in said third heat exchange step. In this embodiment, part of the cold of the cryogenic liquid is recovered in the form of power developed by the two engines, which are preferably turbines, and a part is recovered as cold in the third heat exchange medium which may be used, for example, for refrigeration, e.g. for food freezing or cold storage.

The engines may be employed to drive electrical generators, for example.

The invention will now be illustrated with reference to a preferred embodiment which employs the cold from LNG, and with the aid of the accompanying drawing in which reference numeral 1 is an atmospheric storage tank for LNG, 2, 3 and 4 are heat exchangers, 5 and 6 are power turbines driving electric generators (not shown), and 7, 8 and 9 are pumps.

Referring to the drawing, LNG at about its bubble point at atmospheric pressure, e.g. about −160° C., is withdrawn from tank 1 and raised by the pump 7 to the desired pipeline pressure for distribution, e.g. about 60–80 atm. It then passes in series through exchangers 2, 3 and 4, in which it is warmed to near ambient temperature. Exchangers 2 and 3 serve as condensors for the circulating media in the first and second power cycles, as will be described below. In exchanger 4 the final temperature rise is achieved by means of water or brine or some other medium. The cold removed from the LNG in exchanger 4 is not used for producing electric power. It may be used for other purposes, such as food freezing or cold storage, if desired.

A mixture of methane and ethane of appropriate composition which depends on the composition of the LNG is expanded in the turbine 6 from an elevated pressure, which may be about 40 bar, to a lower pressure of about 20 bar. It leaves the turbine at about −30° C. and is completely condensed in exchanger 3, in thermal contact with LNG and two further returning streams. The condensate is recompressed to slightly above the turbine entry pressure in the pump 9 and returned to the turbine inlet through exchangers 3 and 4. This constitutes the second power cycle in the method of the invention.

A further mixture of methane and ethane, which may have the same composition as the first mixture, is expanded in the turbine 5 from a pressure slightly lower than the exhaust pressure of turbine 6 to a lower pressure, which may be 2–3 bar, is completely condensed in exchanger 2, brought back to the turbine entry pressure in pump 8 and returned to the turbine 5 through exchangers 2, 3 and 4. This stream is completely evaporated in exchanger 3, thus providing additional cold for condensing the stream leaving turbine 6. This constitutes the first power cycle in the method of the invention.

The high pressure stream leaving the pump 9 is partially evaporated during its passage through exchanger 3 and evaporation is completed in exchanger 4. Both streams enter the appropriate turbines as superheated vapours and power is recovered from each of these turbines which may, for example, drive electric generators.

The invention is now further illustrated by the following Example.

EXAMPLE

This Example illustrates the invention using the arrangement shown in the accompanying drawing. The heating medium in exchanger 4 is sea water and the LNG is assumed to be pure methane.

Two hundred tonnes per hour of LNG at −160° C. are pumped to 70 atmospheres in pump 7 and passed through heat exchangers 2, 3 and 4 in that order. The compressed LNG enters heat exchangers 2, 3 and 4 at −150° C., −91° C. and −35° C., respectively. It is recovered from heat exchanger 4 at 0° C. A 50/50 molar mixture of methane and ethane is recovered from heat exchanger 4 at 0° C. and a pressure of 42 bar absolute and is passed to turbine 6 where it is expanded to 22 bar absolute and its dew point of −31° C. It is then condensed in heat exchanger 3 leaving this heat exchanger at −81° C., recompressed in liquid form in pump 9 to 42 bar pressure and passed back through heat exchangers 3 and 4, entering heat exchanger 3 at −79° C. and leaving it at −35° C., still partially in liquid form, and evaporation being completed in heat exchanger 4.

In a further cycle, a 50/50 molar mixture of methane and ethane is recovered from heat exchanger 4 at 0° C. and a pressure of 20 bar absolute and is passed to turbine 5 where it is expanded to 2.6 bar absolute and −80.5° C. It is then condensed in heat exchanger 2, leaving this exchanger at −135° C., recompressed to 20 bar in liquid form in pump 8, and passed back through heat exchangers 2, 3 and 4, entering these exchangers at −133° C., −83° C. and −35° C., respectively, and evaporating in heat exchanger 3.

The circulation of the methane/ethane mixture through turbine 6 is 490 tonnes per hour and through turbine 5 is 95 tonnes per hour.

The dew point and bubble point at 22 bar of the mixture circulating through turbine 6 are −31° C. and −81° C., respectively. The dew point and bubble point at 20 bar of the mixture circulating through turbine 5 are −35 and −83° C., respectively, and the dew point of the mixture condensing at 2.6 bar is −80.5° C.

Turbine 6 generates 6.58 MW of electricity and turbine 5 generates 3.10 MW of electricity, a total of 9.68 MW. The power required by pumps 7, 8 and 9 is 0.95 MW, giving a net power output for the process of 8.73 MW.

The thermodynamic efficiency, i.e. the ratio of the power actually produced to that theoretically available from the LNG, is 45%.

I claim:

1. A method of producing power from a store of a cryogenic liquid containing methane, the method comprising (a) compressing the cryogenic liquid to supercritical pressure;

(b) providing first and second closed and independent power cycles employing, respectively, first and second methane-containing heat exchange media each of which undergoes isobaric condensation over a range of temperatures;

(c) in said first closed power cycle, compressing said first heat exchange medium in condensed form to a superatmospheric pressure $P_2$, evaporating it, expanding the evaporated medium to a lower superatmospheric pressure $P_1$ in a first expansion engine, condensing the expanded vapour and recycling the condensate so formed for recompression;

(d) in said second closed power cycle, compressing said second heat exchange medium in condensed form to a superatmospheric pressure $P_4$, evaporating it, expanding the evaporated medium to a lower superatmospheric pressure $P_3$ in a second expansion engine, condensing the expanded vapour and recycling the condensate so formed for recompression; and wherein (e) the temperature range at which the condensed first heat exchange medium evaporates at $P_2$ is lower than the temperature range at which the expanded second heat exchange medium condenses at $P_3$;

(f) the first heat exchange medium is condensed by indirect heat exchange with said compressed cryogenic liquid in a first heat exchange step at subambient temperature;

(g) the second heat exchange medium is condensed by indirect heat exchange at subambient temperature in a second heat exchange step with evaporating first heat exchange medium and with compressed cryogenic liquid recovered from said first heat exchange step; and (h) power is taken from said first and second engines.

2. A method as claimed in claim 1 in which said first and second heat exchange media have substantially the same composition and $P_3$ is greater than $P_2$.

3. A method as claimed in claim 1 in which said first and second heat exchange media each comprise a mixture of methane and ethane.

4. A method as claimed in claim 1 wherein in a third heat exchange step at subambient temperature said second heat exchange medium is evaporated by indirect countercurrent heat exchange with a third heat exchange medium.

5. A method as claimed in claim 4 in which said second heat exchange medium is evaporated and superheated in said third heat exchange step.

6. A method as claimed in claim 4 in which said third heat exchange medium is aqueous.

7. A method as claimed in claim 4, in which evaporated first heat exchange medium is superheated in said third heat exchange step.

8. A method as claimed in claim 1 in which said condensed first heat exchange medium is warmed, after compression to $P_2$, in the heat exchange step in which the same medium is condensed and in indirect countercurrent heat exchange relationship with the condensing medium.

9. A method as claimed in claim 1 in which said condensed second heat exchange medium is warmed, after compression to $P_4$ in the heat exchange step in which the same medium is condensed and in indirect countercurrent heat exchange relationship with the condensing medium.

* * * * *